US008056496B1

(12) United States Patent
Bussa

(10) Patent No.: US 8,056,496 B1
(45) Date of Patent: Nov. 15, 2011

(54) FLOATING DECK APPARATUS FOR A PONTOON BOAT

(76) Inventor: Patti Bussa, Elk Rapids, MI (US)

( * ) Notice: Subject to any disclaimer, the term of this patent is extended or adjusted under 35 U.S.C. 154(b) by 94 days.

(21) Appl. No.: 12/657,632

(22) Filed: Jan. 25, 2010

(51) Int. Cl.
*B63B 17/00* (2006.01)

(52) U.S. Cl. ..... 114/362

(58) Field of Classification Search ..... 114/343, 114/362; 182/48, 49, 88
See application file for complete search history.

(56) References Cited

U.S. PATENT DOCUMENTS 4,971,315 A 11/1990 Rector
4,993,341 A * 2/1991 Merkel ..... 114/362
5,085,164 A 2/1992 Whitton
5,085,165 A 2/1992 Reed
6,868,799 B2 3/2005 Wright
6,904,863 B2 * 6/2005 Mardikian et al. ..... 114/362
7,028,632 B2 4/2006 Blank
7,134,400 B2 11/2006 Blank
7,255,057 B2 8/2007 Wright

* cited by examiner

*Primary Examiner* — Lars A Olson
(74) *Attorney, Agent, or Firm* — Robert L. McKellar; McKellar IP Law, PLLC

(57) ABSTRACT

A floating deck apparatus (20) includes a plank (40), a pair of tracks (54), a ladder (60), and a pair of handles (64). Each track (54) is coupled to the underside of a boat platform. The pair of tracks rollingly supports the plank (1) in a storage position, (2) in a deck position, and (3) in a ramp position. A proximal stop (88) across the proximal ends (62) of the tracks (54) stops the plank (40) in the ramp position. A distal stop bar (89) across the distal ends (66) of the tracks (54) stops the plank (40) in the storage position. The ladder (64) is movably coupled to the bottom (105) of the plank (40) and pivots from (1) a swimming position to (2) a storage position. The pair of handles (64) is mounted to the plank top (42) or to the plank proximal end (48).

20 Claims, 6 Drawing Sheets

FLOATING DECK APPARATUS FOR A PONTOON BOAT

FIELD OF THE INVENTION

The invention herein disclosed and claimed relates to a boating apparatus and, more particularly, to a floating deck apparatus for a pontoon boat.

BACKGROUND OF THE INVENTION

Pontoon boats are boats in which closed cylinder floats are used to provide buoyancy to an occupant platform. The simplest pontoon boat design is that of a catamaran where two cylinder floats are attached to opposite sides of a single platform. A marine engine is typically attached to the rear of the platform for propulsion. Pontoon boats are very popular for use on freshwater waterways. A very shallow draft reduces damage from collisions with submerged objects or from being run aground. In addition, pontoon boats provide relatively large carrying capacity at a low price.

Although pontoon boats provide large carrying capacity and low draft, the platform is typically elevated a considerable distance above the water due to the underlying cylinder floats. As a result, boat riders are kept high and dry above the water. However, the high ride height makes the platform too high to serve as an effective swim platform. To get to the water, the user must either climb down a relatively high ladder or dive from a considerable height. It is found that many pontoon users would prefer to have a platform that is closer to the water to allow the user to dangle her feet in the water and to get into and out of the water easily. In addition, the high platform makes the pontoon difficult to ingress and egress for persons with physical limitations. Again, the only way onto the boat is to climb up to the platform. This problem is particularly acute where the pontoon boat is in a non-docking situation, such as anchored near shore. Persons with physical limitations find it difficult to ingress and egress the boat without the benefit of a dock.

A primary object of the present invention is to provide a rugged and effective floating deck apparatus for use with a pontoon boat. Another object is to provide a floating deck which may be easily accessed from the pontoon platform, yet is positioned just above the waterline. Another object is to provide a floating deck which may be used as both a swimming deck and as an access ramp. Another object is to provide a floating deck which is easily stored under the pontoon platform while the pontoon is trailered or operated on the water. Another object is to provide a floating deck that easily incorporates comfort features such as beverage holders. Another object is to provide a floating deck that incorporates a movable swimming ladder that is compatible with a storable floating deck. Another object is to provide a floating deck that is easily manufactured from commonly accessible materials.

SUMMARY OF THE INVENTION

A floating deck apparatus of the present invention provides a novel and non-obvious floating deck and ramp for a pontoon boat. The floating deck is storable under the pontoon boat platform of a pontoon boat. In an exemplary embodiment of the present invention, the floating deck apparatus includes a plank, a pair of tracks, a ladder, and a pair of handles. The plank has a top, a right side, a left side, a proximal end, a distal end, a plurality of wheels, and a stopping arm. At least two wheels are rotationally coupled to each of the plank sides. Each track of the pair of tracks has a proximal end, a distal end, and a top. The pair of tracks includes a proximal stop bar and a distal stop bar. Each track top is fixably coupled to the underside of a pontoon boat platform. The pair of tracks is spaced apart in parallel relation. The pair of tracks are operable to rollingly support the plank (1) in a storage position where the plank is entirely under the boat platform, (2) in a swimming position where the plank is partly under the boat platform and partly extended out from under the boat platform, and (3) in a ramp position where the plank is entirely extended out from under the boat platform. The proximal bar stop is mechanically coupled across the proximal ends of each of the tracks and is operable to stop the plank in the ramp position. The distal bar stop is mechanically coupled across the distal ends of each of the tracks and is operable to stop the plank in the storage position. The ladder is movably coupled to the bottom of the plank and operable to pivot from (1) a swimming position where the ladder hangs down from the plank to (2) a storage position where the ladder hangs parallel to the plank. The pair of handles is mounted to the plank top or to the plank proximal end.

The present invention creates several novel and unexpected advantages over the prior art. First, the proximity of the floating deck to the waterline makes it a great platform for swimming, grilling, or lounging. Second, when fully extended, the floating deck is an excellent access ramp. Third, the floating deck is easily stored under the pontoon platform for trailering or operation on the water. Fourth, the floating deck includes convenient beverage holders build into the deck top. Fifth, the floating deck incorporates a swimming ladder for easy access to the water. Sixth the swimming ladder is easily stored under the floating deck. Finally, the floating deck is easily manufactured from commonly accessible materials.

BRIEF DESCRIPTION OF THE DRAWINGS

The present invention and the corresponding advantages and features provided thereby will be best understood and appreciated upon review of the following detailed description of the invention, taken in conjunction with the following drawings, where like numerals represent like elements, in which.

DETAILED DESCRIPTION OF THE INVENTION

Figure 1:
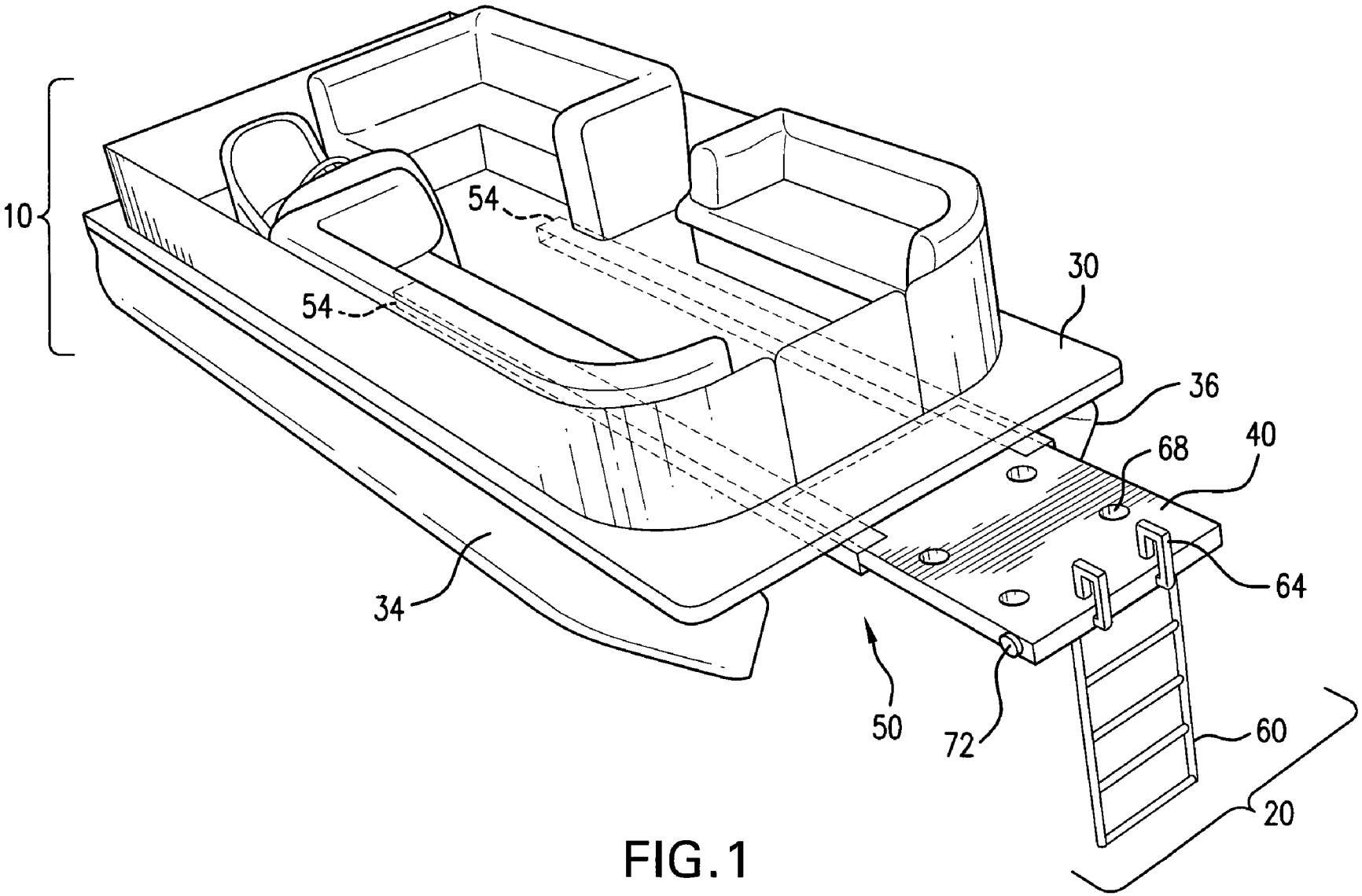
FIG. 1 is an isometric view of an exemplary floating deck apparatus installed on a pontoon boat in accordance with an exemplary embodiment of the invention.

Referring now to FIG. 1, an exemplary floating deck apparatus installed on a pontoon boat in accordance with an exemplary embodiment of the invention is shown in an isometric view. A pontoon boat 10 is shown. Preferably, the novel floating deck apparatus 20 is applied to a pontoon boat 10 of the catamaran type. That is, the pontoon boat 10 has two cylinder floats 34 mounted on each side of the pontoon boat platform 30. More particularly, the catamaran-type pontoon boat 10 leaves a void area 50 under the platform 30 and between the two cylinder floats 34. It is this void area 50 that is used for attaching, storing, and supporting the floating deck apparatus 20.

The floating deck apparatus 30 includes a plank 40, a pair of tracks 54, a ladder 60, and a pair of handles 64. The floating deck apparatus 20 optionally includes beverage retainers 68 in the plank 40. The pair of tracks 54 is attached to the underside of the pontoon boat platform 30. The plank 40 fits between the pair of tracks 54. The plank 40 includes wheels 72 that roll in the tracks 54. The ladder 60 is attached to the underside of the plank 40 and rotates up and under the plank 40 for storage.

The tracks 54 extend far enough under the pontoon boat platform 30 to allow the plank 40 to be rolled completely under the platform 30 to a storage position. In the storage position, the floating deck apparatus 20 is compatible for trailering the boat 10 or for driving the boat 10 in the water. If the plank 40 is rolled about half way out from under the pontoon boat platform 30, as shown in FIG. 1, then it is in a position for use as a swimming deck. In the deck position, the floating deck apparatus 20 is very useful as, for example, a swimming deck, a sunbathing deck, or a grilling deck. If the plank 40 is extended completely out from under the pontoon boat platform 30, then it is stopped such that only a distal end of the plank 40 remain supported by the rails 54. The proximal end of the plank 40 must then be supported by an external contact, such as a beach or boat dock, not shown. In this fully extended, or ramp, position, the floating deck apparatus 20 is very useful as a loading ramp.

Figure 2:
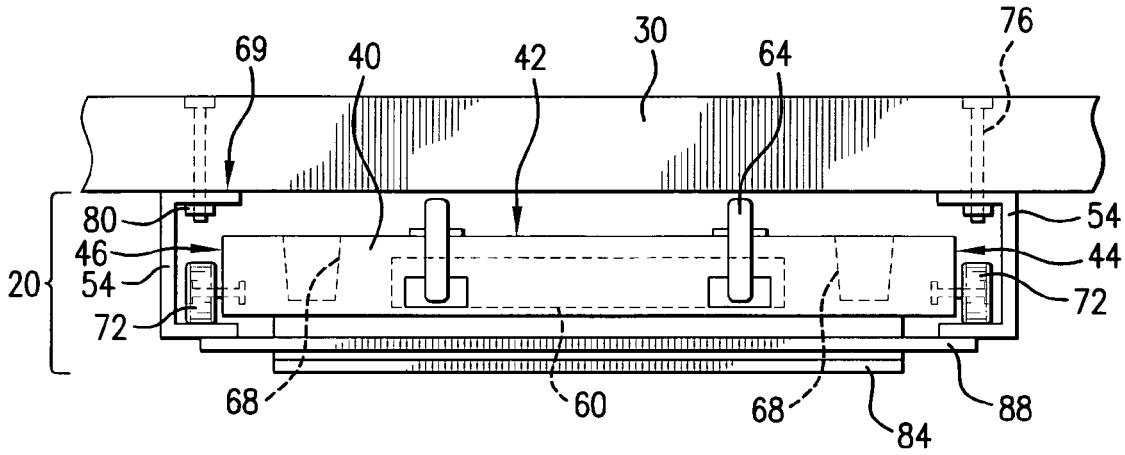
FIG. 2 is a front end view of the exemplary floating deck apparatus installed under a pontoon boat platform in accordance with the exemplary embodiment of the invention.
Figure 3A:
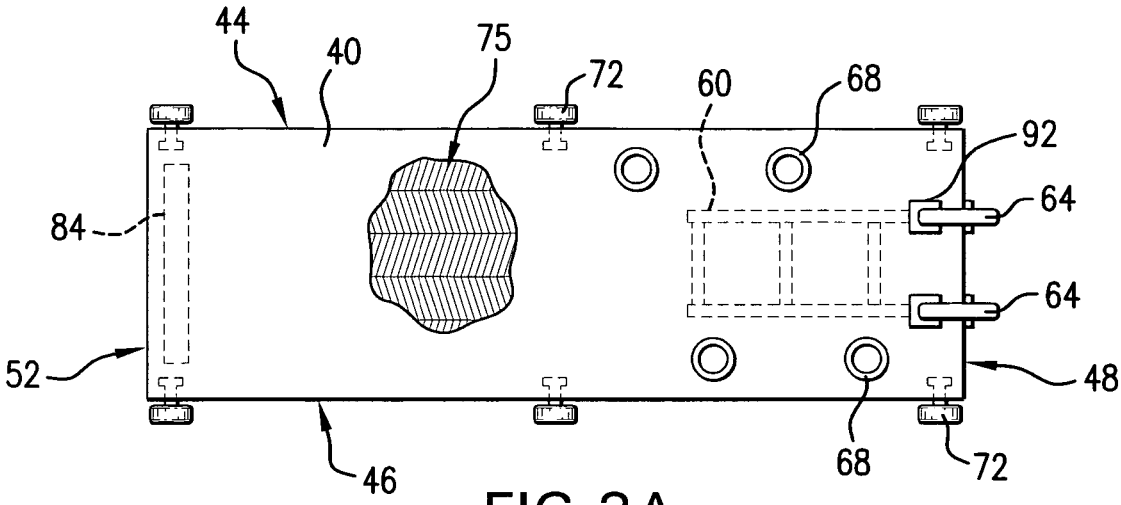
FIGS. 3A and 3B are top and side views, respectively, an exemplary plank for an exemplary floating deck apparatus in accordance with the exemplary embodiment of the invention.
Figure 3B:
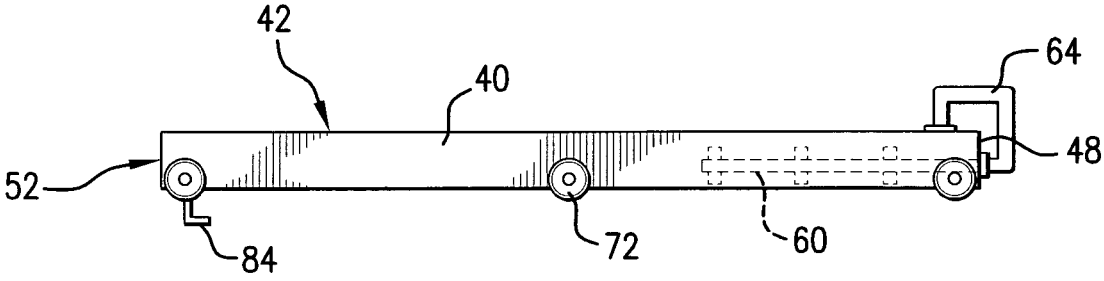
Figure 4A:
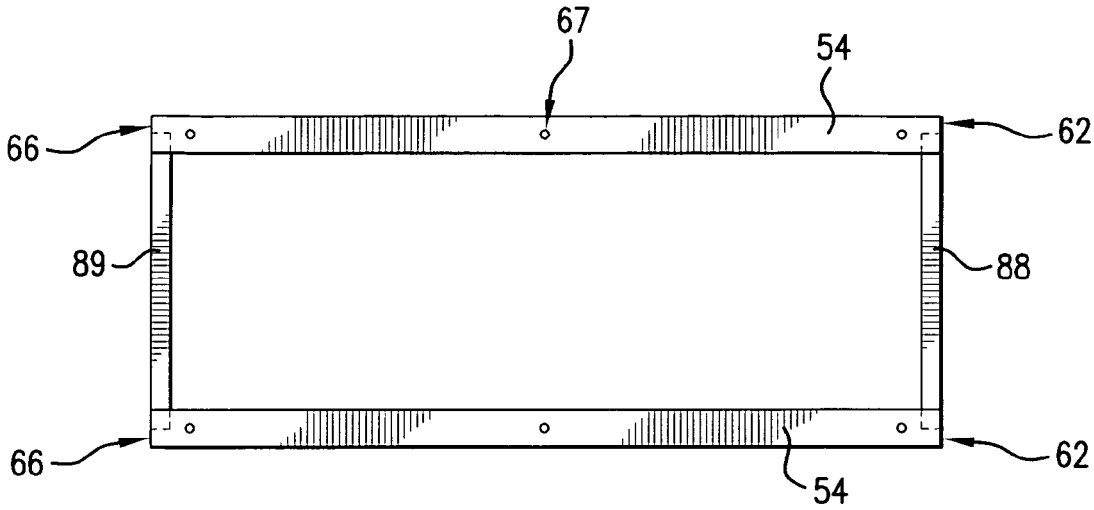
FIGS. 4A and 4B are top and side views, respectively, an exemplary pair of tracks for an exemplary floating deck apparatus in accordance with the exemplary embodiment of the invention.
Figure 4B:
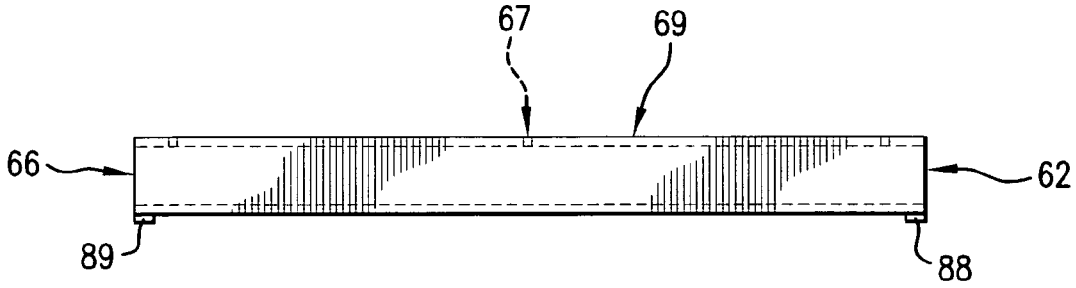

Referring now to FIGS. 2, 3A, 3B, 4A, and 4B, the floating deck apparatus is shown in greater detail. In particular, FIG. 2 is a front end view of the exemplary floating deck apparatus 20 installed under the pontoon boat platform 30 in accordance with the exemplary embodiment of the invention. FIGS. 3A and 3B are top and side views, respectively, of an exemplary plank 40 for the exemplary floating deck apparatus in accordance with the exemplary embodiment of the invention. FIGS. 4A and 4B are top and side views, respectively, an exemplary pair of tracks 54 for the exemplary floating deck apparatus in accordance with the exemplary embodiment of the invention.

The plank 40 has a top 42, a right side 44, a left side 46, a proximal end 48, a distal end 52, a plurality of wheels 72, and a stopping arm 84. When mounted under the pontoon boat platform 30, the plank proximal end 48 points toward the front of the pontoon boat 10, and the plank distal end 52 points toward the back of the pontoon boat 10. At least two wheels 72 are rotationally coupled to each of the plank sides 44 and 46.

In one embodiment, the plank 40 is constructed from aluminum. For example, the plank 40 is formed from extruded aluminum. In another embodiment, the plank 40 is aluminum with vinyl coating. In another embodiment, the plank 40 is formed of a resin-based material. For example, the plank may be formed of resin-based material with fiber glass filler. In another embodiment, the plank 40 includes a grid work 75 formed into the top surface 42. Particularly in FIG. 3A, the plank 40 is shown with grid work 75. By texturing the top 42 of the plank 40 with a grid-work 75, the surface is made non-slip and, if the grid extends through the bulk of the plank 40, the plank 40 drains water. This feature is especially useful where the floating deck apparatus 20 is used as a swimming deck. In a preferred embodiment, the plank 40 is formed from a continuous section of extruded aluminum boat dock of between about 10 and 12 feet in length and between about 3 and 5 feet in width, such as is commercially available.

The plank stopping arm 84 is preferably an L-shaped extension under the plank 40. The stopping arm 84 preferably is constructed from metal, such as aluminum. The stopping arm 84 preferably is L-shaped, where the shape conforms to, but is somewhat larger than, the proximal stopping bar 88 between the tracks 54. With this configuration, the stopping arm 84 of the plank 40 catches on the proximal stopping bar 88 of the tracks when the plank 40 is extended fully from the front of the pontoon boat platform 30. The stopping arm 84 also contacts the distal stopping bar 89 when the plank 40 is retracted completely under the pontoon boat platform 30.

The floating deck apparatus 20 optionally includes at least one beverage retainer 68 in the plank 40. Preferably, the beverage retainers 68 are formed as openings through the top 42 of the plank.40. More preferably, the beverage retainers 68 are plastic inserts into openings in the top 42 of the plank 40.

Each track 54 of the pair of tracks has a proximal end 62, a distal end 66, and a top 69. When mounted to the underside of the pontoon boat platform 30, the track proximal ends 62 point toward the front of the pontoon boat 10, and the track distal ends 66 point towards the back of the pontoon boat 10. The pair of tracks 54 includes a proximal stop bar 88 and a distal stop bar 89. Each track top 69 is fixably coupled to the underside of a pontoon boat platform 30. The pair of tracks 54 is spaced apart in parallel relation. The pair of tracks 54 rollingly supports the plank 40 (1) in a storage position where the plank is entirely under the boat platform, (2) in a swimming position where the plank is partly under the boat platform and partly extended out from under the boat platform, and (3) in a ramp position where the plank is entirely extended out from under the boat platform. The proximal bar stop 88 is mechanically coupled across the proximal ends 62 of each of the tracks 54 and stops the plank 40 in the ramp position. The distal bar stop 89 is mechanically coupled across the distal ends 66 of each of the tracks 54 and stops the plank 40 in the storage position.

The tracks 54 are preferably formed as channels, more preferably as C-channels. Preferably, metal C-channel stock, such as aluminum, is used for the tracks 54. The C-channel tracks are preferably between 10 and 12 feet long, such as are commercially available. The tracks 54 are attached to the underside of the pontoon boat platform 30 by, for example, bolts 76 and 80 extending though holes 67 in the top 69 of the tracks 54. The C-channel shape is preferable to support the plank wheels 72 and to conceal the plank 40 between the pair of tracks 54 when in the storage position.

Figure 5A:
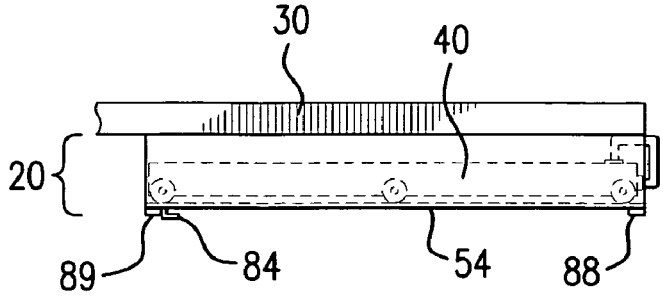
FIGS. 5A, 5B, and 5C are side views of the exemplary floating deck apparatus in accordance with the exemplary embodiment of the invention showing operation of the apparatus in the storage, deck, and ramp positions.
Figure 5B:
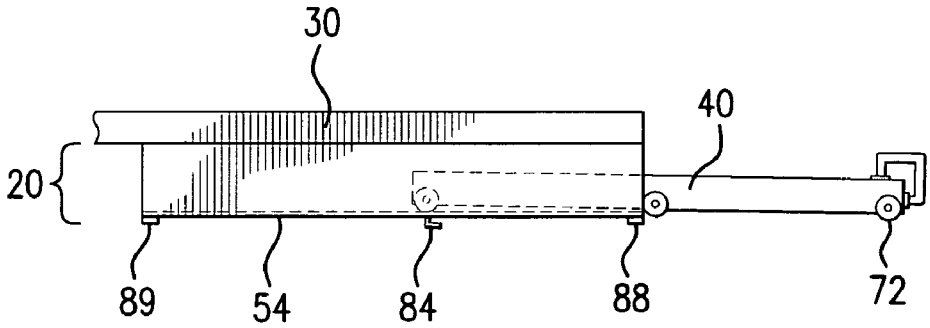
Figure 5C:
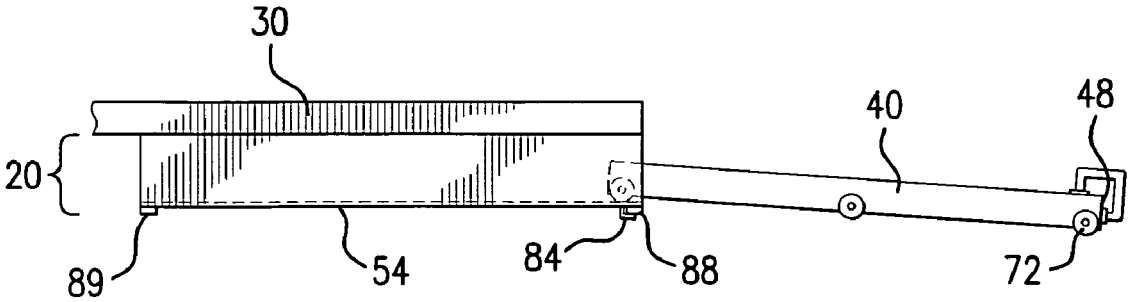

Referring now to FIGS. 5A, 5B, and 5C, the exemplary floating deck apparatus 20 in accordance with the exemplary embodiment of the invention is shown in side view. In particularly, the operation of the apparatus 20 is shown in the storage, deck, and ramp positions, in FIGS. 5A, 5B, and 5C, respectively. In the storage position, the plank 40 is completely retracted under the pontoon boat platform 30. The plank stopping arm 84 contacts the distal stopping bar 89 to stop the further rearward travel of the plank 40. In the deck position, the plank 40 is extended beyond the pontoon boot platform 30 until the plank 40 is about half retracted and half extended. Preferably, the plank 40 has three pairs of wheels 72 attached to the sides. At the deck position, only one of the pairs of wheels 72 remains supported on the tracks. Once the middle pair of wheels 72 extends beyond the tracks 54, the plank 40 drops to a slight downward angle. The fact that the plank 40 is then supported, in part, directly on the side of the plank 40 increases the friction between the plank 40 and the track pair 54 such that the plank 40 stays in place. In the ramp position, the entire plank 40 is extended beyond the pontoon boat platform 30. The plank stopping arm 84 catches on the proximal stopping bar 88 of the track pair 54 to retain the plank 40 in the tracks 54. The proximal end 48 of the plank 40 is supported by, for example, a beach or a boat dock.

Figure 6:
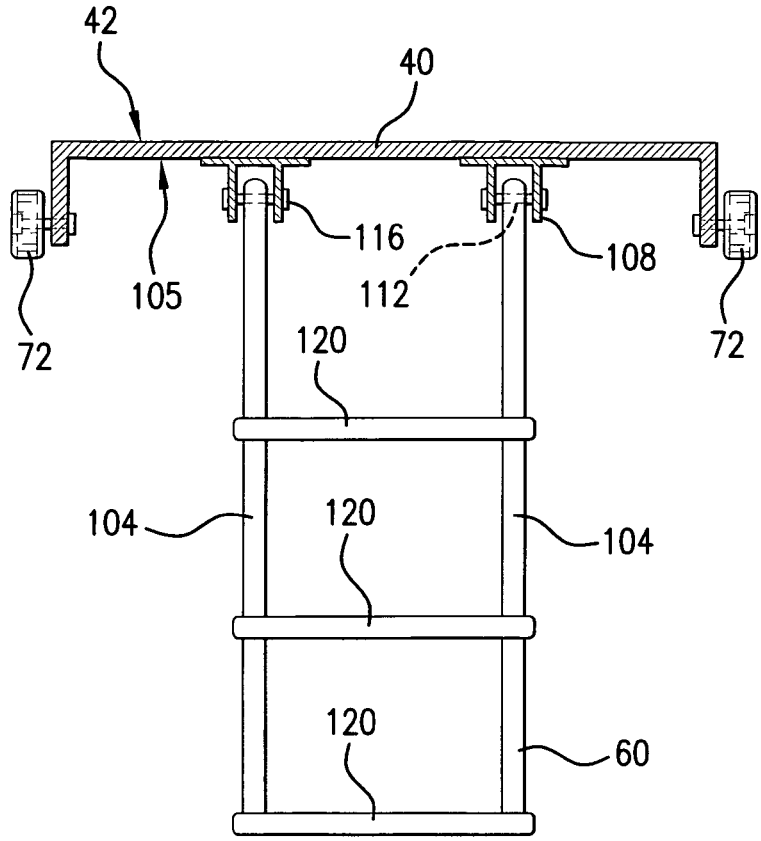
FIG. 6 is a first cross-sectional, view of the exemplary floating deck apparatus showing an exemplary embodiment of a movable swimming ladder in accordance with an exemplary embodiment of the invention.

Referring now to FIG. 6 an exemplary embodiment of a movable swimming ladder 60 for the exemplary floating deck apparatus in accordance with the exemplary embodiment of the invention is shown in a first cross-sectional view. In particular, the ladder 60 is coupled to the bottom 105 of the plank 40. Preferably, the plank 40 has a hollow cross-section to allow the ladder 60 to be pivoted to a storage position where the ladder 60 is stored within the plank 54. In this first cross section, the ladder 60 is shown as two legs 104 connected by a series of rungs 120. The legs 120 preferably are constructed of metal, such as aluminum tubing. The rungs 120 preferably are constructed of plastic. The legs 120 are movably coupled to the bottom of the plank 40 via mounts 108, pins 120, and keeps 116. Preferably, the mounts 108, pins 120, and keeps 116 are metal.

Figure 7:
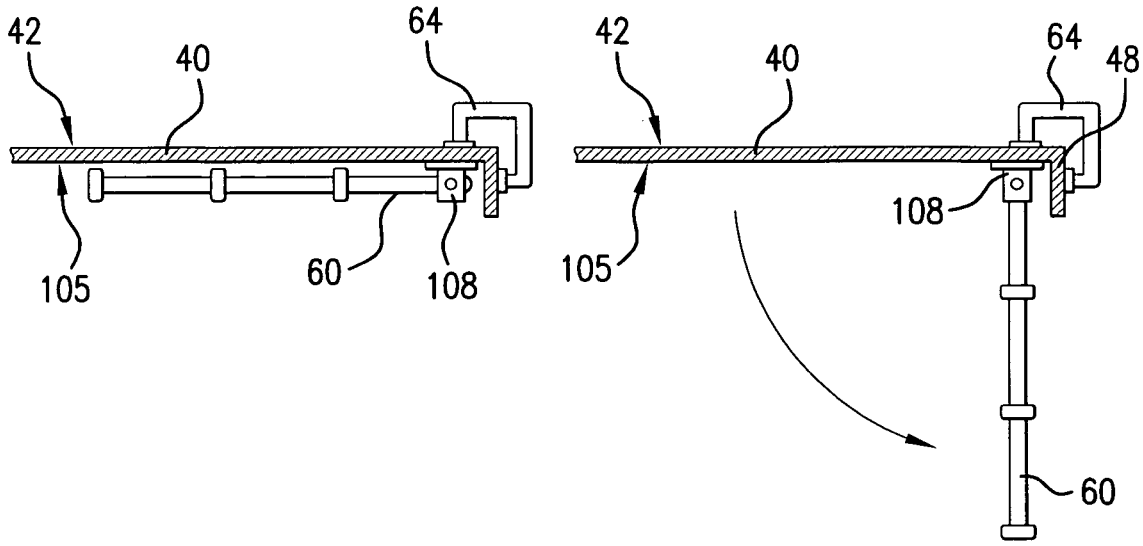
FIG. 7 is a second cross-sectional view of the exemplary floating deck apparatus showing the exemplary movable swimming ladder in storage and swimming positions in accordance with an exemplary embodiment of the invention.

FIG. 7 the exemplary movable swimming ladder 60 is shown in a second cross-sectional view. In this view, the ladder 60 is shown pivoting within the mounts 108. The ladder 60 moves from a storage position—where the ladder 60 hangs parallel to the plank 40—to a swimming position—where the ladder 60 hangs down from the plank 40. In addition, a pair of handles 64 is shown. The handles 64 are mounted either to the top 42 of the plank 40 or to the proximal end 48 of the plank 40 or to both, as shown. The handles 64 provide safety handholds for swimmer egress or ingress of the floating deck apparatus. Preferably, the handles 64 are plastic.

The above detailed description of the invention, and the examples described therein, has been presented for the purposes of illustration and description. While the principles of the invention have been described above in connection with a specific device, it is to be clearly understood that this description is made only by way of example and not as a limitation on the scope of the invention.

What is claimed is:

1. A floating deck apparatus for a boat, the apparatus comprising:

a plank having a top, a right side, a left side, a proximal end, a distal end, a plurality of wheels, and a stopping arm, wherein at least two wheels are rotationally coupled to each of the plank sides;

a pair of tracks, each track having a proximal end, a distal end, and a top, and the pair having a proximal stop bar and a distal stop bar, wherein each track top is fixably coupled to the underside of a boat platform, wherein the pair of tracks are spaced apart in parallel relation and are operable to rollingly support the plank (1) in a storage position where the plank is entirely under the boat platform, (2) in a deck position where the plank is partly under the boat platform and partly extended out from under the boat platform, and (3) in a ramp position where the plank is entirely extended out from under the boat platform, wherein the proximal bar stop is mechanically coupled across the proximal ends of each of the tracks and is operable to stop the plank in the ramp position, and wherein the distal bar stop is mechanically coupled across the distal ends of each of the tracks and is operable to stop the plank in the storage position;

a ladder movably coupled to the bottom of the plank and operable to pivot from (1) a swimming position where the ladder hangs down from the plank to (2) a storage position where the ladder hangs parallel to the plank; and a pair of handles mounted to the plank top or to the plank proximal end.

2. The apparatus of claim 1 wherein the plank is extruded aluminum.

3. The apparatus of claim 1 wherein the plank is vinyl-coated aluminum.

4. The apparatus of claim 1 wherein the plank is a resin-based material.

5. The apparatus of claim 1 wherein the tracks are aluminum.

6. The apparatus of claim 1 wherein the plank top has a grid-work top surface.

7. The apparatus of claim 1 wherein the stopping arm is an L-shaped extension under the plank.

8. A floating deck apparatus for a boat, the apparatus comprising:

a plank having a top, a right side, a left side, a proximal end, a distal end, a plurality of wheels, a stopping arm, and at least one beverage retainer opening through the top, wherein at least two wheels are rotationally coupled to each of the plank sides; and a pair of tracks, each track having a proximal end, a distal end, and a top, and the pair having a proximal stop bar and a distal stop bar, wherein each track top is fixably coupled to the underside of a boat platform, wherein the pair of tracks are spaced apart in parallel relation and are operable to rollingly support the plank (1) in a storage position where the plank is entirely under the boat platform, (2) in a deck position where the plank is partly under the boat platform and partly extended out from under the boat platform, and (3) in a ramp position where the plank is entirely extended out from under the boat platform, wherein the proximal bar stop is mechanically coupled across the proximal ends of each of the tracks and is operable to stop the plank in the ramp position, and wherein the distal bar stop is mechanically coupled across the distal ends of each of the tracks and is operable to stop the plank in the storage position.

9. The apparatus of claim 8 wherein the plank is extruded aluminum.

10. The apparatus of claim 8 wherein the plank is vinyl-coated aluminum.

11. The apparatus of claim 8 wherein the plank is a resin-based material.

12. The apparatus of claim 8 wherein the tracks are aluminum.

13. The apparatus of claim 8 wherein in the at least one beverage retainer is a resin-based material.

14. The apparatus of claim 8, further comprising:

a ladder movably coupled to the bottom of the plank and operable to pivot from (1) a swimming position where the ladder hangs down from the plank to (2) a storage position where the ladder hangs parallel to the plank; and a pair of handles mounted to the plank top or to the plank proximal end.

15. The apparatus of claim 8 wherein the plank top has a grid-work top surface.

16. The apparatus of claim 8 wherein the stopping arm is an L-shaped extension under the plank.

17. A floating deck apparatus for a boat, the apparatus comprising:

a plank having a top, a right side, a left side, a proximal end, a distal end, a plurality of wheels, and a stopping arm, and at least one beverage retainer opening through the top, wherein at least two wheels are rotationally coupled to each of the plank sides, wherein the plank is aluminum, and wherein the plank has a grid-work top surface;

a pair of tracks, each track having a proximal end, a distal end, and a top, and the pair having a proximal stop bar and a distal stop bar, wherein each track top is fixably coupled to the underside of a boat platform, wherein the pair of tracks are spaced apart in parallel relation and are operable to rollingly support the plank (1) in a storage position where the plank is entirely under the boat platform, (2) in a deck position where the plank is partly under the boat platform and partly extended out from under the boat platform, and (3) in a ramp position where the plank is entirely extended out from under the boat platform, wherein the proximal bar stop is mechanically coupled across the proximal ends of each of the tracks and is operable to stop the plank in the ramp position, and wherein the distal bar stop is mechanically coupled across the distal ends of each of the tracks and is operable to stop the plank in the storage position;

a ladder movably coupled to the bottom of the plank and operable to pivot from (1) a swimming position where the ladder hangs down from the plank to (2) a storage position where the ladder hangs parallel to the plank; and a pair of handles mounted to the plank top or to the plank proximal end.

18. The apparatus of claim 17 wherein the plank is vinyl-coated.

19. The apparatus of claim 17 wherein the tracks are aluminum.

20. The apparatus of claim 17 wherein the stopping arm is an L-shaped extension under the plank.

* * * * *